US010617910B1

(12) United States Patent
Harris

(10) Patent No.: US 10,617,910 B1
(45) Date of Patent: Apr. 14, 2020

(54) MOUTHPIECE

(71) Applicant: Jawzrsize, LLC, Wailuku, HI (US)

(72) Inventor: Brandon Harris, Wailuku, HI (US)

(73) Assignee: Jawzrsize, LLC, Wailuku, HI (US)

( * ) Notice: Subject to any disclaimer, the term of this patent is extended or adjusted under 35 U.S.C. 154(b) by 297 days.

(21) Appl. No.: 15/470,983

(22) Filed: Mar. 28, 2017

Related U.S. Application Data

(60) Provisional application No. 62/316,655, filed on Apr. 1, 2016.

(51) Int. Cl.
*A63B 23/03* (2006.01)
*A63B 21/002* (2006.01)
*A63B 21/02* (2006.01)

(52) U.S. Cl.
CPC ..... *A63B 23/032* (2013.01); *A63B 21/0023* (2013.01); *A63B 21/023* (2013.01)

(58) Field of Classification Search
CPC ... A63B 23/032; A61F 5/566; A61M 16/0493
See application file for complete search history.

(56) References Cited

U.S. PATENT DOCUMENTS

2012/0145162 A1* 6/2012 Haddix ..... A61M 16/0488 128/207.17
2015/0114403 A1* 4/2015 Togliatti ..... A61F 5/566 128/848

* cited by examiner

*Primary Examiner* — Jennifer Robertson
(74) *Attorney, Agent, or Firm* — Brient IP Law, LLC

(57) ABSTRACT

The mouthpiece is adapted for insertion into a mouth of an end user. The mouthpiece enables teeth of an end user to clinch up and down so as to exercise the muscles associated with the jaw and head of the end user. The mouthpiece comprises an adjustable resistance. The mouthpiece further comprises an exterior surface that includes a superior dental arch cavity that accommodates the superior dentition. The mouthpiece further comprises an interior surface that includes an inferior dental arch cavity that accommodates the inferior dentition. The mouthpiece comprises a posterior surface that includes a shelf that is adapted to interface with a tongue. Optionally, the superior dental arch cavity has a curvature that coincides with the superior dental arch. Further, the inferior dental arch cavity has a curvature that coincides with the inferior dental arch.

20 Claims, 4 Drawing Sheets

MOUTHPIECE

CROSS REFERENCES TO RELATED APPLICATIONS

This non-provisional application claims priority to a provisional application 62/316,655 that was filed on Apr. 1, 2016.

STATEMENT REGARDING FEDERALLY SPONSORED RESEARCH

Not Applicable

REFERENCE TO APPENDIX

Not Applicable

BACKGROUND OF THE INVENTION

The present invention relates to the field of sports games and amusements including apparatus for physical training, more specifically, an exercise apparatus specially adapted for the head, face, and neck that is inserted into the mouth.

Mouthpieces have been around for a longtime. Typical mouthpieces enable an end user to insert the mouthpiece into a pot of bowling water to soften the mouthpiece, and then insert into the mouth in order for the teeth to clinch down onto the mouthpiece thereby setting the form of the mouthpiece around the teeth.

There are a multitude of different mouthpieces currently available. Some mouthpieces are directed to strictly protecting an end user's teeth, whereas other mouthpieces are proscribed by a dentist, and enable a sleeper to clinch his or her teeth onto the mouthpiece without the fear of wearing down his or her teeth.

What is needed is a mouthpiece that enables an end user to clinch down his or teeth in order to squeeze the mouthpiece thereby providing a facial exercise. What is further needed is the ability to adjust the biting resistance of the mouthpiece.

SUMMARY OF INVENTION

These needs as well as others are addressed in the device of the present disclosure.

The presented disclosure relates to the field of boil and bite mouthpieces, more specifically, a mouthpiece that when installed enables a user to clinch his or her jaws in order to squeeze a cavity formed within the mouthpiece. Moreover, the ability to squeeze the cavity formed within the mouthpiece enables a user to activate nerves, increase blood flow in and around the mouth, release stress, and exercise the muscles associated with the jaw.

The mouthpiece is a mouthpiece that is adapted to be inserted into a mouth of an end user. The mouthpiece enables teeth of an end user to clinch up and down in order to squeeze a cavity within the mouthpiece. The cavity of the mouthpiece provides resistance so as to exercise the muscles associated with the jaw and head of the end user. The cavity may be partially filled with a removable insert in order to adjust a resistance of the overall mouthpiece. The mouthpiece further comprises an exterior surface that includes a superior dental arch cavity that is adapted to accommodate superior dentition of the end user. The mouthpiece further comprises an interior surface that includes an inferior dental arch cavity that is adapted to accommodate inferior dentition of the end user. The mouthpiece is further defined with a posterior surface that includes a shelf that is adapted to interface with a tongue of the end user. The overhead profile of the mouthpiece may resemble a clam in shape. The cavity extends across a left side to a right side of the mouthpiece. Optionally, the superior dental arch cavity has a curvature that coincides with the superior dental arch. Further, the inferior dental arch cavity has a curvature that coincides with the inferior dental arch.

These together with additional objects, features and advantages of the mouthpiece will be readily apparent to those of ordinary skill in the art upon reading the following detailed description of the presently preferred, but nonetheless illustrative, embodiments when taken in conjunction with the accompanying drawings.

In this respect, before explaining the current embodiments of the mouthpiece in detail, it is to be understood that the mouthpiece is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the mouthpiece.

It is therefore important that the claims be regarded as including such equivalent construction insofar as they do not depart from the spirit and scope of the mouthpiece. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
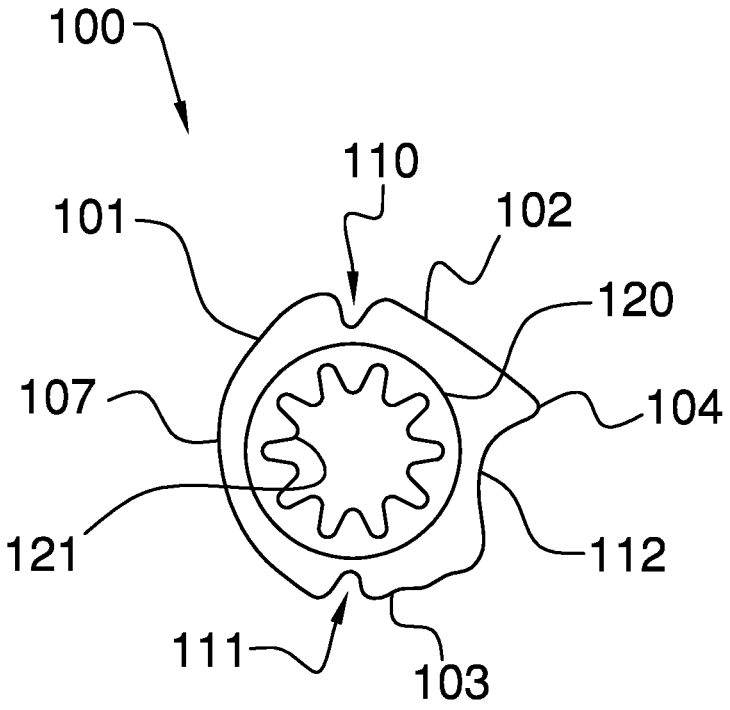
FIG. 1 is a side view of an embodiment of the disclosure.
Figure 2:
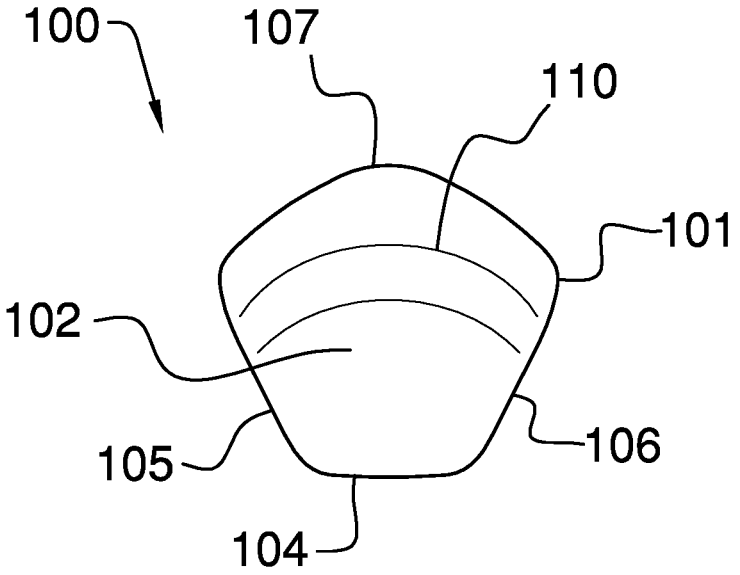
FIG. 2 is a top view of an embodiment of the disclosure.
Figure 3:
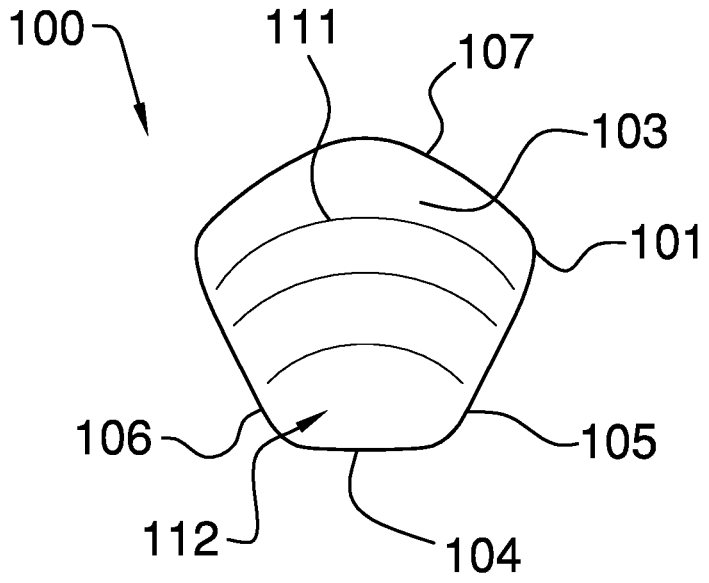
FIG. 3 is a bottom in use view of an embodiment of the disclosure in use.
Figure 4:
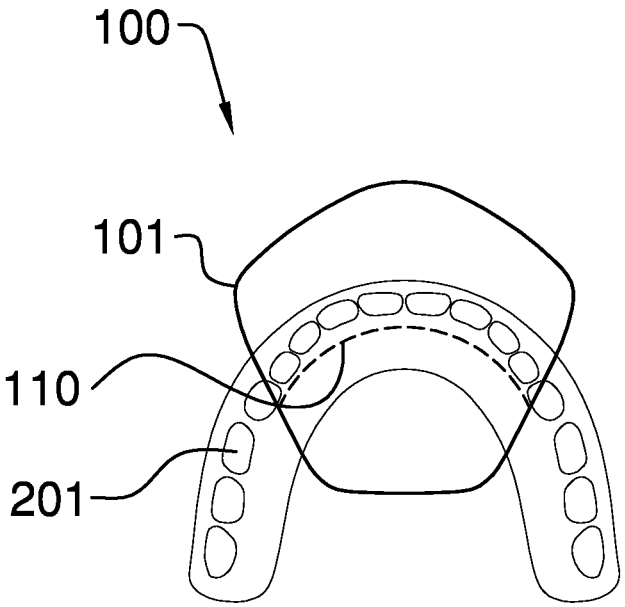
FIG. 4 is an in use view of an embodiment of the disclosure.
Figure 5:
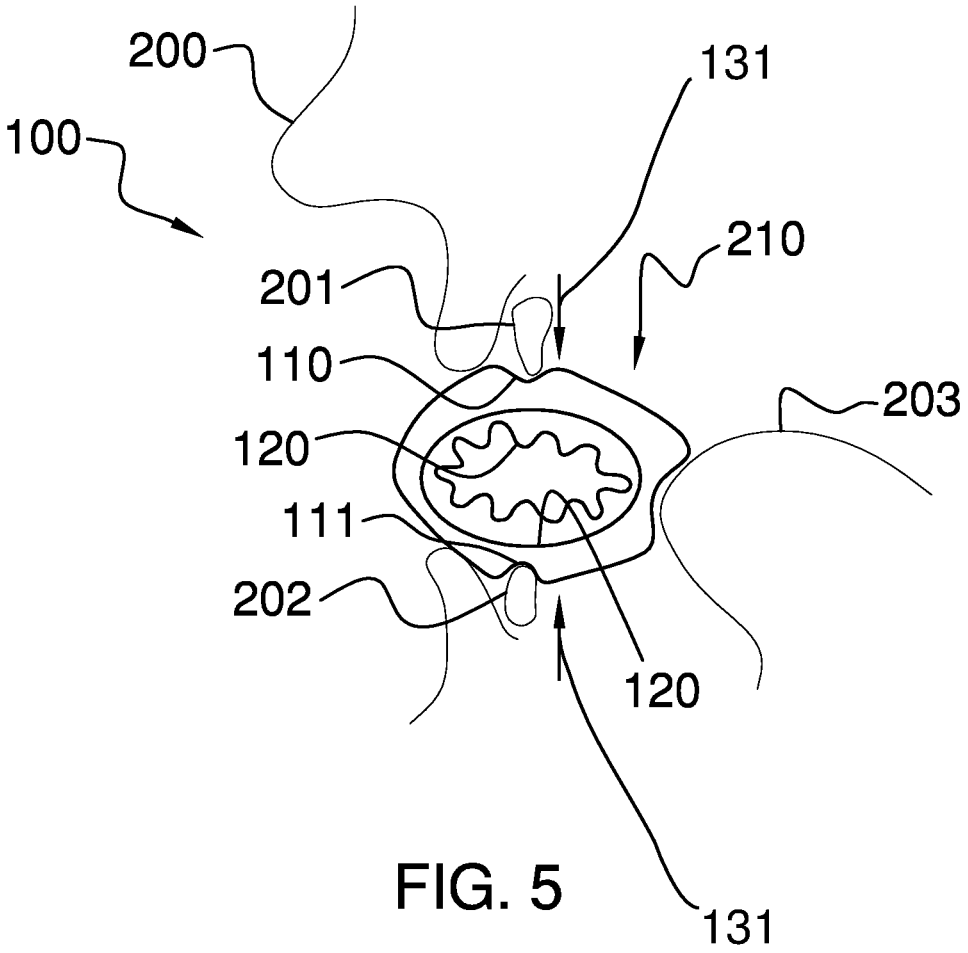
FIG. 5 is a side in use view of an embodiment of the disclosure.
Figure 6:
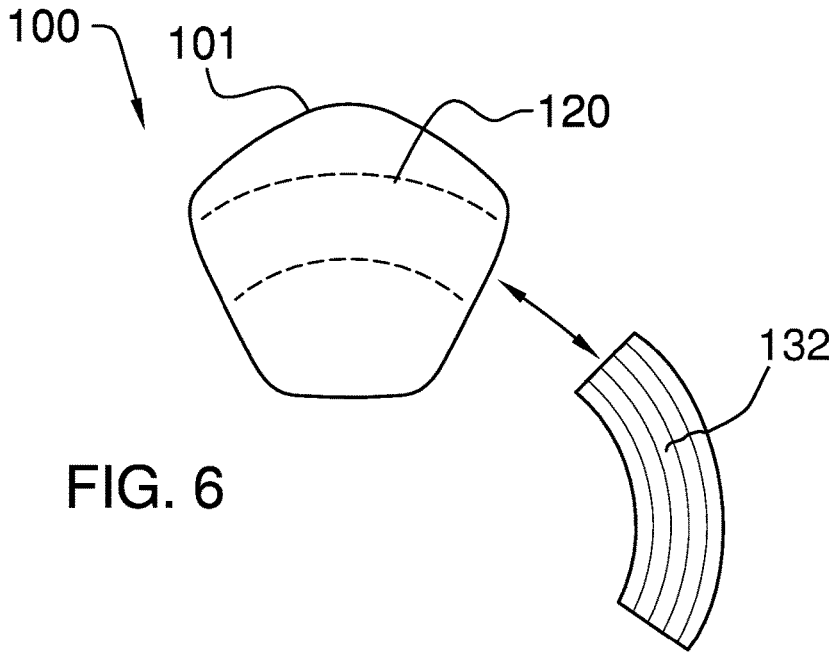
FIG. 6 is an exploded view of an embodiment of the disclosure.
Figure 7:
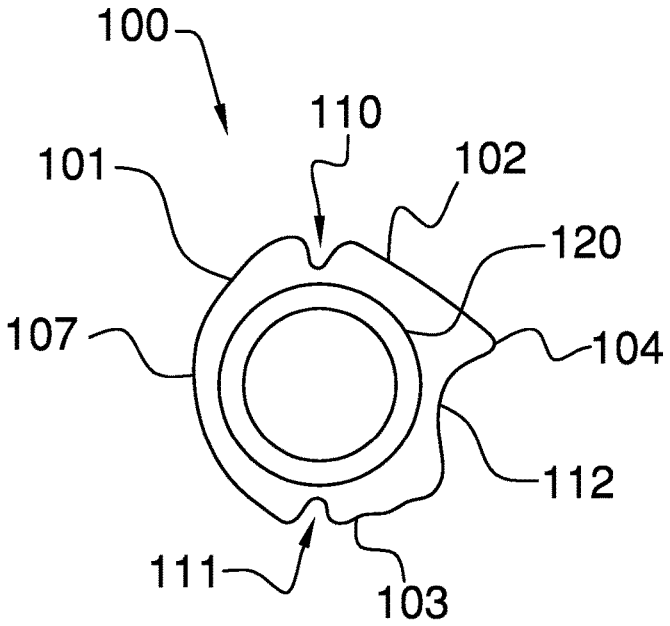
FIG. 7 is a side view of an alternate embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The mouthpiece 100 (hereinafter invention) relates to the field of boil and bite mouthpieces 101, more specifically, a mouthpiece 101 that when installed enables an end user 200 to clinch his or her jaws in order to squeeze a cavity 120 formed within the mouthpiece 101. Moreover, the ability to squeeze the cavity 120 formed within the mouthpiece 101 enables the end user 200 to activate nerves, increase blood flow in and around the mouth 210 thereby releasing stress and exercising the muscles associated with the jaw.

The invention 100 is a mouthpiece 101 that is adapted to be inserted into a mouth 210 of an end user 200. The invention 100 enables dentition of an end user 200 to clinch up and down in order to squeeze a cavity 120 within the mouthpiece 101. The cavity 120 of the mouthpiece 101 provides resistance so as to exercise the muscles associated with the jaw and head of the end user 200. The cavity 120 may be partially filled with a removable insert 121 in order to adjust a resistance of the overall mouthpiece 101. The mouthpiece 101 further comprises an exterior surface 102 that includes a superior dental arch cavity 110 that is adapted to accommodate superior dentition 201 of the end user 200. The mouthpiece 101 further comprises an inferior dental arch cavity 111 that formed in the exterior surface 102 of the mouthpiece 101 and that is adapted to accommodate inferior dentition 202 of the end user 200. The mouthpiece 101 is further defined with a posterior surface 104 that includes a tongue shelf 112 that is adapted to receive and support the tongue 203 of the end user 200. The overhead profile of the mouthpiece 101 may resemble a clam in shape. The cavity 120 extends across a left side surface 105 to a right side surface 106 of the mouthpiece 101. The superior dental arch cavity 110 has a curvature that coincides with the superior dental arch of the end user 200. Further, the inferior dental arch cavity 111 has a curvature that coincides with the inferior dental arch of the inferior dentition 202 of the end user 200.

As best illustrated in FIGS. 1 through 6, the invention generally comprises a mouthpiece 101 that when viewed overhead has a shape that roughly follows the dental arch of the superior dentition 201 and the dental arch of the inferior dentition 202. When viewed from left side of the end user 200 or the right side of the end user 200, as shown most clearly in FIGS. 5 and 7, the mouthpiece 101 has a roughly tubular shape. The hollow space formed by this tubular structure of the mouthpiece 101 forms a cavity 120. The mouthpiece 101 is further defined with an exterior surface 102, an interior surface 103, a posterior surface 104, a left side surface 105, a right side surface 106, and an anterior surface 107.

The left side surface 105 is acutely oriented with respect to the right side surface 106. The anterior surface 107 has a curvature that follows the curvatures of the dental arch of the superior dentition 201 and the dental arch of the inferior dentition 202. The posterior surface 104 is generally linear. The left side surface 105 is a mirror image of the right side surface 106.

Referring to FIG. 1, the exterior surface 102 and the interior surface 103 have a curvilinear contour, which is visible from a profile view. Moreover, the exterior surface 102 further comprises a superior dental arch cavity 110. The superior dental arch cavity 110 is a cavity that is formed with a curvature that is adapted to receive the superior dentition 201 of an end user 200. Likewise, the exterior surface 102 further comprises an inferior dental arch cavity 111. The inferior dental arch cavity 111 is a cavity that is formed with a curvature that is adapted to receive the inferior dentition of the end user 200.

The exterior surface 102 of the posterior surface 104 is further formed to include a tongue shelf 112. The tongue shelf 112 is a concave recess that is formed along the exterior surface 102 of the posterior surface 104. As shown most clearly in FIG. 5, the tongue shelf 112 is adapted to receive the tongue 203 of the end user 200.

The superior dentition 201 and the inferior dentition 202 of the end user 200 are adapted to squeeze the invention 100. The tongue 203 and the tongue shelf 112 combine to limit how far back the invention 100 is able to go within the mouth 210 of the end user 200. It shall be noted that the tongue shelf 112 is a concave recess that extends inwardly as well as downwardly with respect to both the exterior surface 102 of the posterior surface 104.

The mouthpiece 101 is further defined with a cavity 120 that extends across an interior portion of the mouthpiece 101. The negative space that forms the cavity 120 is bounded by the interior surface 103. In fact, the cavity 120 extends between the left side surface 105 and the right side surface 106. The cavity 120 may have a curvature that corresponds and aligns with the superior dental arch cavity 110 as well as the inferior dental arch cavity 111. The cavity 120 may have a circular cross-section, and reduces the overall rigidity of the mouthpiece 101. The cavity 120 makes it possible to squeeze the mouthpiece 101 via the superior dental arch cavity 110 and the inferior dental arch cavity 111.

In the first potential embodiment of the disclosure, the mouthpiece 101 of the invention 100 is formed as a single piece from a molded elastomeric material. The mouthpiece 101 essentially forms a compressive spring. Specifically, when the end user 200 generates a biting motion, a compressive force 131 is applied to the mouthpiece 101. The compressive force 131 on the mouthpiece 101 creates a resistive force that opposes the compressive force 131 generated by the biting motion in an attempt by the mouthpiece 101 to return the mouthpiece 101 to its relaxed shape. This spring like action of the mouthpiece 101 allows to user to perform isometric exercises with the mouth 210.

In a second potential embodiment of the disclosure, a removable insert 121 may be included with the invention 100. The removable insert 121 is able to be positioned within the cavity 120 in order to adjust the overall modulus of the mouthpiece 101. The removable insert 121 may be made of the same or a dissimilar material than the mouthpiece 101. Moreover, the removable insert 121 and the mouthpiece 101 may be made of a plastic, latex, or a rubber. The removable insert 121 may have a curvature that is consistent with the curvature of the cavity 120.

In the second potential embodiment of the disclosure, the removable insert 121 of the invention 100 is formed as a single piece from a molded elastomeric material. Specifically, when the end user 200 generates a biting motion, a compressive force 131 is applied to the removable insert 121. The compressive force 131 on the removable insert 121 creates a resistive force that opposes the compressive force 131 generated by the biting motion in an attempt by to return the removable insert 121 to its relaxed shape.

When the removable insert 121 is inserted into the cavity 120 of the mouthpiece 101, the modulus of the resistance of the mouthpiece 101 to a compressive force 131 is increased. By selecting the modulus of the removable insert 121, the overall modulus of the invention 100 to be adjusted. When a plurality removable inserts 121 are provisioned, the modulus of each individual removable insert 121 can be varied using a method selected from the group consisting of: 1) adjusting the modulus of the elastomeric material used to form each individual removable insert 121; 2) varying the amount of elastomeric material used to form; or, 3) to add a plurality of ridges 132 in such a manner that changes the internal stress strain force distribution within each individual removable insert 121.

In a third potential embodiment of the disclosure, the invention 100 is adapted for use by a specific end user by: 1) heating the mouthpiece 101 to a temperature that creates an inelastic plasticity within the mouthpiece 101. The end user 200 then bites into the mouthpiece 101 such that the superior dentition 201 and the inferior dentition 202 of the end user 200 directly creates the superior dental arch cavity 110 and the inferior dental arch cavity 111 of the mouthpiece 101.

The following definitions and directional references were used in this disclosure:

Anterior: As used in this disclosure, anterior is a term that is used to refer to the front, or face side, of a human body. When comparing two objects, the anterior object is the object that is closer to front, or face side, of the human body.

Arch: As used in this disclosure, an arch refers to a curved edge or surface that bounds a definable object or surface.

Cavity: As used in this disclosure, a cavity is an empty space or negative space that is formed within an object.

Compression Spring: As used in this disclosure, a compression spring is a wire coil that resists forces attempting to compress the wire coil in the direction of the center axis of the wire coil. The compression spring will return to its original position when the compressive force is removed.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Dental Arch: As used in this disclosure, the dental arch refers to the curvature formed by the dentition. There are two dental arches in a person that are commonly referred to as the superior dental arch and the inferior dental arch.

Dentition: As used in this disclosure, a dentition refers to a set of teeth and a set of descriptive characteristics of the set of teeth especially with regard to their number, kind, arrangement, and condition. The dentition is divided into a superior dentition and an inferior dentition.

Elastic: As used in this disclosure, an elastic is a material or object that deforms when a force is applied to it and that is able to return to its original shape after the force is removed. A material that exhibits these qualities is also referred to as an elastomeric material.

Exterior: As used in this disclosure, the exterior is use as a relational term that implies that an object is not contained within the boundary of a structure or a space.

Inferior: As used in this disclosure, inferior refers to a directional sense or location of the body. Specifically, inferior refers to an object or a side of an object that is proximal to the feet or distal from the head of the body.

Interior: As used in this disclosure, the interior is use as a relational term that implies that an object is contained within the boundary of a structure or a space.

Lateral: As used in this disclosure, lateral refers to a directional sense or location of the body. Specifically, lateral refers to an object or a side of an object that is proximal to the side or distal from the medial axis of the body.

Medial Axis: As used in this disclosure, the medial axis is the center line of the body as the line is drawn from the head to the foot. When two objects are compared relative to the medial axis, the object closer to the medial axis is referred to as the medial object and the object distal from the medial axis is referred to as the lateral object.

Medial: As used in this disclosure, medial refers to a directional sense or location of the body. Specifically, medial refers to an object or a side of an object that is proximal to the medial axis or distal from of the side body.

Modulus: As used in this disclosure, the modulus of an elastomeric object is a function that describes the percentage change in the span of the elastomeric object as a function of the force applied to the elastomeric object. When comparing modulus, a larger modulus is taken to imply that an increase in force is required to get the same percentage change in the elastomeric object.

Negative Space: As used in this disclosure, negative space is a method of defining an object through the use of open or empty space as the definition of the object itself, or, through the use of open or empty space to describe the boundaries of an object.

Posterior: As used in this disclosure, posterior is a term that is used to refer to the side of a human body that is distal from the anterior side. When comparing two objects, the posterior object is the object that is distal from the anterior side of the human body.

Relaxed Shape: As used in this disclosure, a structure is considered to be in its relaxed state when no shear, strain, or torsional forces are being applied to the structure.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Superior: As used in this disclosure, superior refers to a directional sense or location of the body. Specifically, superior refers to an object or a side of an object that is distal from the feet or proximal to the head of the body.

The directional references used in this disclosure correspond to the directional references from the perspective of a person. As such, left refers to the direction towards the left side of the person and right refers to the direction towards the right side of the person. Superior refers to the direction towards the head of the wearer and inferior refers to the direction towards the feet of the wearer. Anterior refers to front side of the person and posterior refers to the back side of the person.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A jaw exercise apparatus, comprising:

a mouthpiece configured for positioning between a superior dentition and an inferior dentition of a user, the mouthpiece comprising:

an anterior surface configured to be facing outward away from the user when the mouthpiece is positioned between the superior dentition and the inferior dentition of the user;

a posterior surface opposite the anterior surface and configured to be facing inward toward the user when the mouthpiece is positioned between the superior dentition and the inferior dentition of the user;

a left side surface configured to be facing a left side of the user when the mouthpiece is positioned between the superior dentition and the inferior dentition of the user;

a right side surface configured to be facing a right side of the user when the mouthpiece is positioned between the superior dentition and the inferior dentition of the user;

an interior surface defining a cavity, the cavity extending between the left side surface and the right side surface, and one or more removable inserts, each removable insert comprising a modulus of elasticity such that inserting the removable insert within the cavity of the mouthpiece changes the modulus of elasticity of the mouthpiece and one or more ridges configured to provide a desired internal stress strain force distribution within the removable insert.

2. The jaw exercise apparatus of claim 1, wherein the mouthpiece further comprises:

a superior dental arch cavity comprising a curvature configured to receive a superior dentition of the user and extending from the left side surface to the right side surface; and an inferior dental arch cavity comprising a curvature configured to receive an inferior dentition of the user and extending from the left side surface to the right side surface.

3. The jaw exercise apparatus of claim 2, wherein the superior dental arch cavity and the inferior dental arch cavity each comprises a channel or indentation formed in the exterior surface.

4. The jaw exercise apparatus of claim 2, wherein the superior dental arch cavity and the inferior dental arch cavity each comprises one or more pieces of material molded to the superior dentition or the inferior dentition of the user.

5. The jaw exercise apparatus of claim 2, wherein the superior dental arch cavity, the inferior dental arch cavity, and the cavity each comprises a mouthpiece curvature that corresponds to a dental arch curvature associated with a superior dental arch and an inferior dental arch of the user.

6. The jaw exercise apparatus of claim 1, wherein the anterior surface is substantially continuous.

7. The jaw exercise apparatus of claim 1, wherein the cavity comprises a substantially circular cross-section.

8. The jaw exercise apparatus of claim 1, wherein the cavity is configured to secure a removable insert within to change the modulus of elasticity of the mouthpiece.

9. The jaw exercise apparatus of claim 1, wherein the mouthpiece further comprises a tongue shelf defined by the posterior surface.

10. The jaw exercise apparatus of claim 9, wherein the tongue shelf comprises a concave recess configured to receive at least a portion of a tongue of the user.

11. The jaw exercise apparatus of claim 1, wherein the mouthpiece comprises an elastomeric material.

12. A method for providing a jaw exercise apparatus, the method comprising:

forming a mouthpiece from elastomeric material configured for positioning between a superior dentition and an inferior dentition of a user, comprising:

forming an anterior surface of the mouthpiece configured to be facing outward away from the user when the mouthpiece is positioned between the superior dentition and the inferior dentition of the user;

forming a posterior surface of the mouthpiece opposite the anterior surface and configured to be facing inward toward the user when the mouthpiece is positioned between the superior dentition and the inferior dentition of the user;

forming a left side surface of the mouthpiece configured to be facing a left side of the user when the mouthpiece is positioned between the superior dentition and the inferior dentition of the user;

forming a right side surface of the mouthpiece configured to be facing a right side of the user when the mouthpiece is positioned between the superior dentition and the inferior dentition of the user;

forming a cavity defined by an interior surface, the cavity extending between the left side surface and the right side surface;

forming a superior dental arch cavity comprising a curvature configured to receive a superior dentition of the user and extending from the left side surface to the right side surface; and forming an inferior dental arch cavity comprising a curvature configured to receive an inferior dentition of the user and extending from the left side surface to the right side surface.

13. The method of claim 12, further comprising providing a plurality of removable inserts, each removable insert comprising a different modulus of elasticity such that inserting the removable insert within the cavity of the mouthpiece changes the modulus of elasticity of the mouthpiece.

14. The method of claim 13, wherein each of the plurality of removable inserts comprises one or more ridges configured to provide a desired internal stress strain force distribution within the removable insert.

15. The method of claim 12, further comprising forming a concave recess in the posterior surface to create a tongue shelf configured to receive at least a portion of a tongue of the user.

16. A jaw exercise system, comprising:

a mouthpiece configured for positioning between a superior dentition and an inferior dentition of a user, the mouthpiece comprising:

an anterior surface configured to be facing outward away from the user when the mouthpiece is positioned between the superior dentition and the inferior dentition of the user;

a posterior surface opposite the anterior surface and configured to be facing inward toward the user when the mouthpiece is positioned between the superior dentition and the inferior dentition of the user;

a left side surface configured to be facing a left side of the user when the mouthpiece is positioned between the superior dentition and the inferior dentition of the user;

a right side surface configured to be facing a right side of the user when the mouthpiece is positioned between the superior dentition and the inferior dentition of the user;

a superior dental arch cavity comprising a curvature configured to receive a superior dentition of the user and extending from the left side surface to the right side surface;

an inferior dental arch cavity comprising a curvature configured to receive an inferior dentition of the user and extending from the left side surface to the right side surface; and an interior surface defining a cavity, the cavity extending between the left side surface and the right side surface; and a plurality of removable inserts, each removable insert comprising a different modulus of elasticity such that inserting the removable insert within the cavity of the mouthpiece changes the modulus of elasticity of the mouthpiece.

17. The jaw exercise system of claim 16, wherein the cavity comprises a substantially circular cross-section, and wherein the mouthpiece further comprises a tongue shelf defined by a concave recess within the posterior surface.

18. A method for providing a jaw exercise apparatus, the method comprising:

forming a mouthpiece from elastomeric material configured for positioning between a superior dentition and an inferior dentition of a user, comprising:

forming an anterior surface of the mouthpiece configured to be facing outward away from the user when the mouthpiece is positioned between the superior dentition and the inferior dentition of the user;

forming a posterior surface of the mouthpiece opposite the anterior surface and configured to be facing inward toward the user when the mouthpiece is positioned between the superior dentition and the inferior dentition of the user;

forming a left side surface of the mouthpiece configured to be facing a left side of the user when the mouthpiece is positioned between the superior dentition and the inferior dentition of the user;

forming a right side surface of the mouthpiece configured to be facing a right side of the user when the mouthpiece is positioned between the superior dentition and the inferior dentition of the user;

forming a cavity defined by an interior surface, the cavity extending between the left side surface and the right side surface; and providing a plurality of removable inserts, each removable insert comprising a different modulus of elasticity such that inserting the removable insert within the cavity of the mouthpiece changes the modulus of elasticity of the mouthpiece.

19. The method of claim 18, wherein each of the plurality of removable inserts comprises one or more ridges configured to provide a desired internal stress strain force distribution within the removable insert.

20. The method of claim 18, further comprising forming a concave recess in the posterior surface to create a tongue shelf configured to receive at least a portion of a tongue of the user.

* * * * *